US011236704B2

(12) United States Patent
Oka et al.

(10) Patent No.: US 11,236,704 B2
(45) Date of Patent: Feb. 1, 2022

(54) PRIMARY PUMP AND CARBURETOR USING THE SAME

(71) Applicant: ZAMA JAPAN CO. LTD., Iwate (JP)

(72) Inventors: Hiroyuki Oka, Iwate (JP); Kazunori Tabata, Iwate (JP); Toshiyuki Kuyo, Iwate (JP)

(73) Assignee: ZAMA JAPAN KABUSHIKI KAISHA, Iwate (JP)

( * ) Notice: Subject to any disclaimer, the term of this patent is extended or adjusted under 35 U.S.C. 154(b) by 0 days.

(21) Appl. No.: 16/943,038

(22) Filed: Jul. 30, 2020

(65) Prior Publication Data

US 2021/0033045 A1 Feb. 4, 2021

(51) Int. Cl.
*F02M 17/04* (2006.01)
*F02M 7/08* (2006.01)

(52) U.S. Cl.
CPC ..... *F02M 17/04* (2013.01); *F02M 7/08* (2013.01)

(58) Field of Classification Search
CPC ..... F02M 7/08; F02M 17/04
See application file for complete search history.

(56) References Cited

U.S. PATENT DOCUMENTS 6,561,495 B2 * 5/2003 Woody ..... F02M 1/16 123/179.11

* cited by examiner

*Primary Examiner* — Robert A Hopkins
(74) *Attorney, Agent, or Firm* — One LLP

(57) ABSTRACT

An improved primary pump for a carburetor is provided. The primary pump has a reduced cost and reduced space construction. The primary pump includes: a flexible cap having a cavity; an inlet open to the cavity of the flexible cap; an inlet side path fluidly coupled to the inlet; an inlet side check valve disposed in the inlet side path; an outlet open to the cavity of the flexible cap; an outlet side path fluidly coupled to the outlet; and an outlet side check valve disposed on the outlet side path, wherein at least one among the inlet side check valve and the outlet side check valve comprises a flap formed in a pump diaphragm of a fuel pump of the carburetor.

4 Claims, 11 Drawing Sheets

PRIMARY PUMP AND CARBURETOR USING THE SAME

CROSS-REFERENCED TO RELATED APPLICATION

The subject application claims the benefit of Japanese Patent Application No. 2019-141407, filed Jul. 31, 2019, which application is incorporated herein by reference in its entirety.

TECHNICAL FIELD

The present disclosure relates to a carburetor that mixes fuel with air and feeds it to a general-purpose engine or the like, and a pump for a carburetor, specifically and not by way of limitation, to a manual type primary pump for feeding fuel to a carburetor to be used during startup of an engine or the like.

BACKGROUND

Many general-purpose engines used as a driving source in portable machinery for agricultural and forestry, miniature vehicles, or the like, are fed fuel via a carburetor that includes a fixed quantity fuel chamber partitioned from the air by a metering diaphragm and configured to adjust fuel at a set pressure and send the fuel to an intake path.

As illustrated in FIG. 6, a well-known method for introducing fuel to the fixed quantity fuel chamber is to form a fuel pump in a carburetor main body. A pump diaphragm PD is used to separate a pump chamber P1, which is in communication with a fuel tank, and a pulse pressure chamber P2, which is in communication with a crank case of an engine E. The fuel pump suctions and sends fuel from a fuel tank using a pump operation that utilizes a positive or negative pulse pressure conveyed from the crank case of the engine E while the engine E is running.

The pump diaphragm PD is provided with two check valves, an aspiration-side check valve and a sending side check valve. The aspiration-side check valve opens during fuel suction when the pulse pressure is negative and closes during fuel sending when the pulse pressure is positive. The sending-side check valve closes during fuel suction when the pulse pressure is negative and opens during fuel sending when the pulse pressure is positive.

However, the pulse pressure is not present before engine startup. Thus, an operator must perform a startup operation using a recoil rope or the like. After a negative pressure is generated in the engine, the fuel is suctioned out by the carburetor. This startup operation must be repeated several times by the operator, which must perform the inconvenient task of the startup operation.

FIGS. 7 and 8 illustrate a known primary pump used as a startup device of a carburetor. This primary pump repeatedly presses and deforms a cap made of an elastic resin to generate pressure for suctioning fuel from the fuel tank, via a fuel introduction path, and for feeding the fuel to the fixed quantity fuel chamber, via the pump chamber.

The action of such a primary pump feeds fuel into the fixed quantity fuel chamber and the pump chamber before engine startup, which can fill the fixed quantity fuel chamber with fuel for use during engine startup. Filling the pump chamber with fuel gives the fuel a priming action and enables smooth suction and transfer of the fuel after engine startup.

Excess fuel from the fixed quantity fuel chamber and the pump chamber is returned from the outlet to the fuel tank through a reflux path. As a result of this configuration malfunctions such as fuel overflow do not occur.

The primary pump requires two check valves, an outlet-side check valve and an inlet-side check valve. The outlet-side check valve opens when the cap is pressed down and compressed, and closes when the cap returns to its original state after being pressed down. The inlet-side check valve closes when the cap is pressed down and compressed and opens when the cap returns to its original state after being pressed down. This configuration reflects an increase in cost and a higher risk of malfunctions, as well as being a heavy burden for carburetors used in general-purpose engines that must be housed in a limited space.

SUMMARY OF THE INVENTION

The present disclosure provides an improved primary pump for a carburetor having a fuel pump and used to mix fuel with air and feed the fuel-air mixture to a general-purpose engine. The primary pump, which has a reduced cost and reduced space construction, is configured to feed fuel to the carburetor to be used during startup of the general-purpose engine.

The present disclosure provides a carburetor with an improved primary pump that has a reduced cost and reduced space construction. The carburetor having a fuel pump and being disposed in a fuel introduction path from a fuel tank to the engine, is used to mix fuel with air and feed the fuel-air mixture to a general-purpose engine. The primary pump is configured to feed fuel to the carburetor to be used during startup of the general-purpose engine.

In some embodiments, the primary pump includes: a flexible cap having an interior cavity; an inlet in fluid communication with the interior cavity of the flexible cap; an inlet side path formed extending from the inlet; an inlet side check valve disposed on the inlet side path; an outlet in fluid communication with the interior cavity of the flexible cap; an outlet side path formed extending from the outlet; and an outlet side check valve disposed on the outlet side path, wherein at least one among the inlet side check valve and the outlet side check valve comprises a flap formed on a pump diaphragm of a fuel pump of the carburetor. The flexible cap can be made from a flexible resin.

In another embodiment, an improved carburetor for mixing fuel and air and feeding the fuel-air mixture to an engine and being disposed in a fuel introduction path from a fuel tank to the engine, is provided. The carburetor includes: an intake path formed in the carburetor main body; a throttle valve disposed in the intake path and configured to adjust the opening surface area thereof; a metering unit for feeding fuel at a predetermined pressure to the intake path and having an interior being partitioned by a metering diaphragm into a fixed quantity fuel chamber and an air chamber; a fuel pump having an interior being partitioned by a pump diaphragm into a pulse pressure chamber and a pump chamber, the pump diaphragm is configured to be displaced by a pulse pressure conveyed to the pulse pressure chamber from a crank case of the engine, wherein fuel is suctioned from the fuel tank to the pump chamber and sent to the fixed quantity fuel chamber; and a primary pump for suctioning fuel from the fuel tank, wherein the primary pump can be manual type or the like. The primary pump includes: a flexible cap having a cavity; an inlet open to the cavity of the flexible cap; an inlet side path connecting the fixed quantity fuel chamber to the inlet; an inlet side check valve disposed in the inlet side path; an outlet open the cavity of the flexible cap; an outlet side path connecting the fuel tank to the outlet; and an outlet side check valve disposed in the outlet side path where at least one among the inlet side check valve and the outlet side check valve comprises a flap formed in the fuel pump diaphragm.

In some embodiments, a flap is formed in the pump diaphragm and serves as at least one check valve from among the check valves on the inlet side and the outlet side of the primary pump that suctions fuel to be used during engine startup. The flaps formed on the pump diaphragm, which function as check valves of the fuel pump for feeding and sending fuel using a pulse pressure of an engine, can also provide excellent primary pump function. By using flap check valves formed on the pump diaphragm for primary pump function, the number of components can be reduced, and cost reduction can be achieved. Having the check valve function exhibited by a flap enables simple construction and space reduction as compared to conventional check valves using a spring, a ball, or the like.

Other systems, devices, methods, features and advantages of the subject matter described herein will be or will become apparent to one with skill in the art upon examination of the following figures and detailed description. It is intended that all such additional systems, methods, features and advantages be included within this description, be within the scope of the subject matter described herein, and be protected by the accompanying claims. In no way should the features of the example embodiments be construed as limiting the appended claims, absent express recitation of those features in the claims.

DETAILED DESCRIPTION

Before giving a detailed description of the primary pump and the carburetor using the primary pump in the present invention, a description will be given for the construction of a conventional carburetor.

Figure 6:
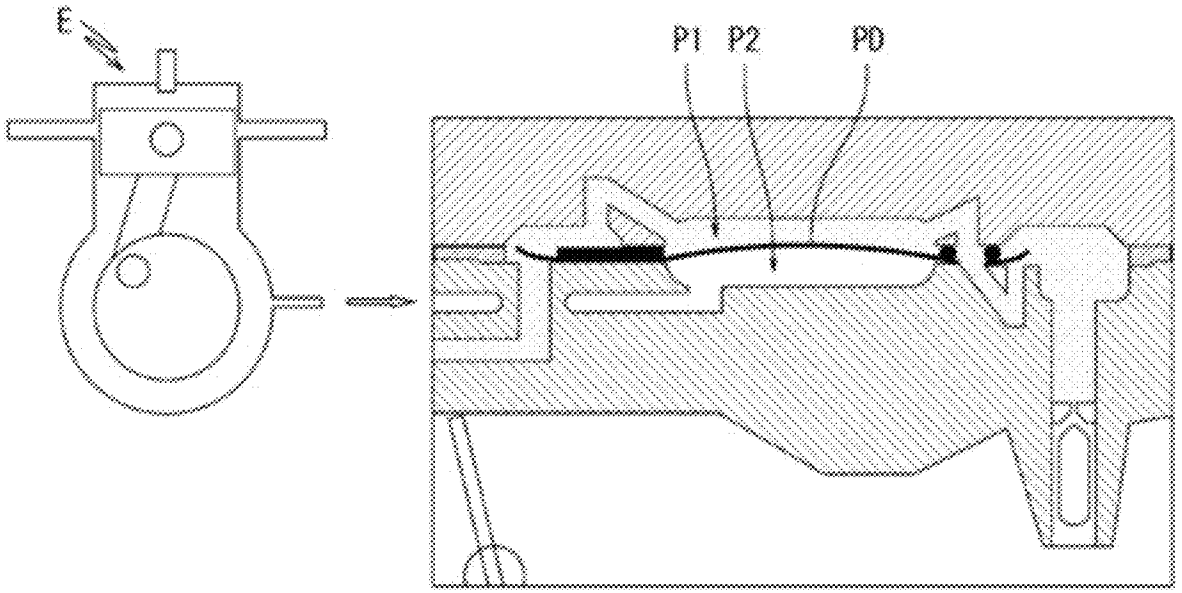
FIG. 6 (prior art)
FIG. 6 illustrates the operative mechanism of a conventional fuel pump having a pump diaphragm.
Figure 7:
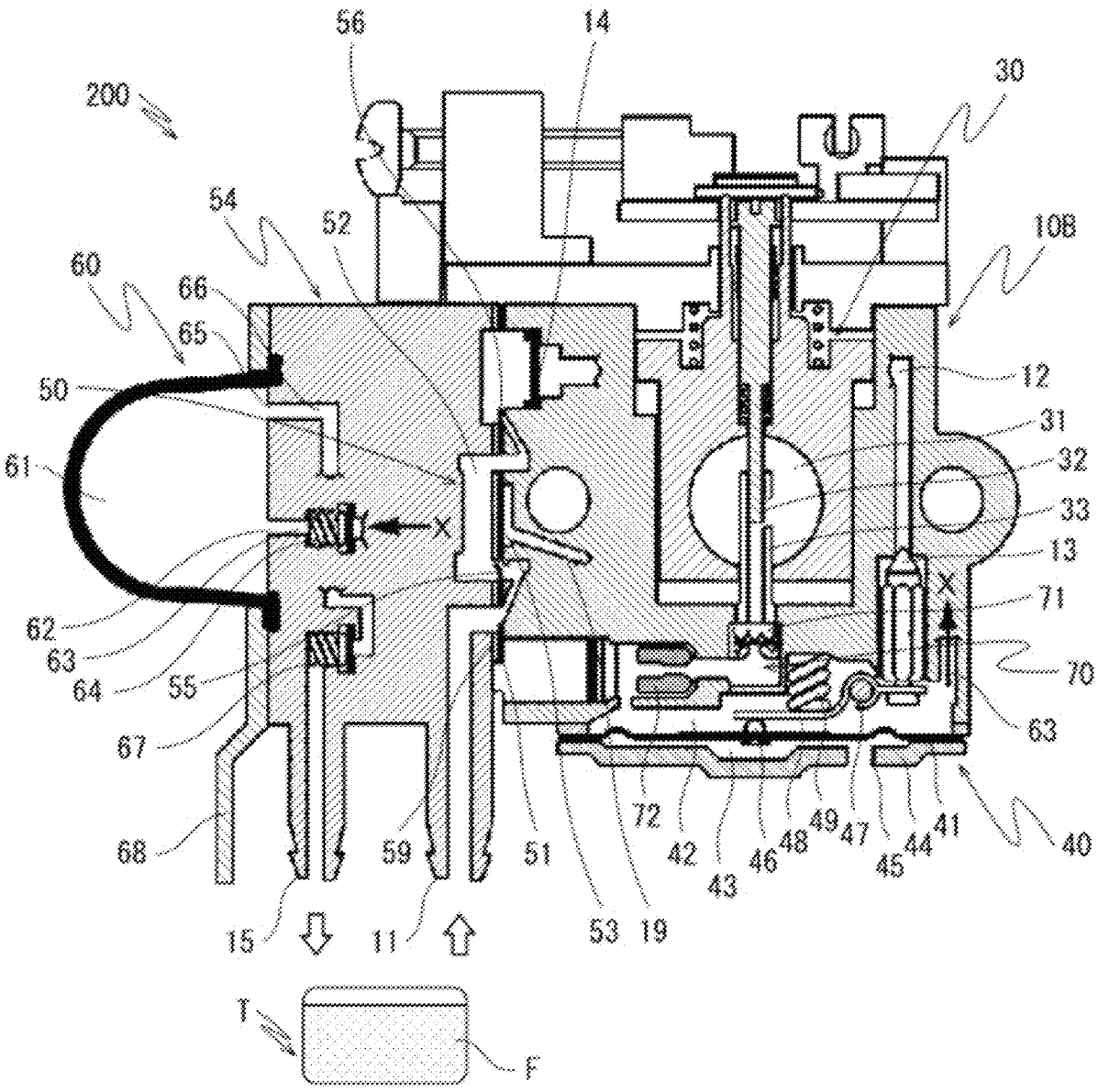
FIG. 7 (prior art)
FIG. 7 is a cross-sectional view illustrating a conventional carburetor with a manual type primary pump.
Figure 8:
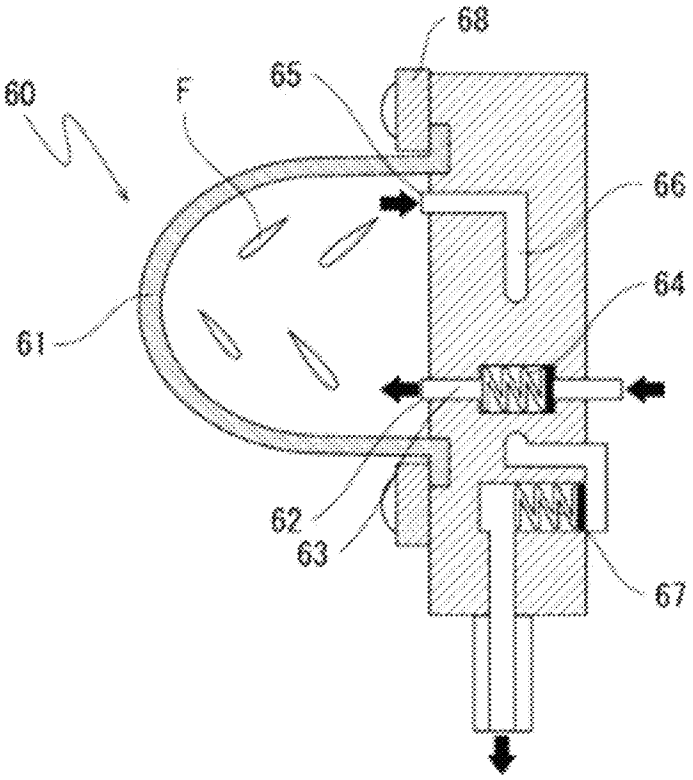
FIG. 8 (prior art)
FIG. 8 is a cut-out view illustrating the operative mechanism of a conventional primary pump.
Figure 9:
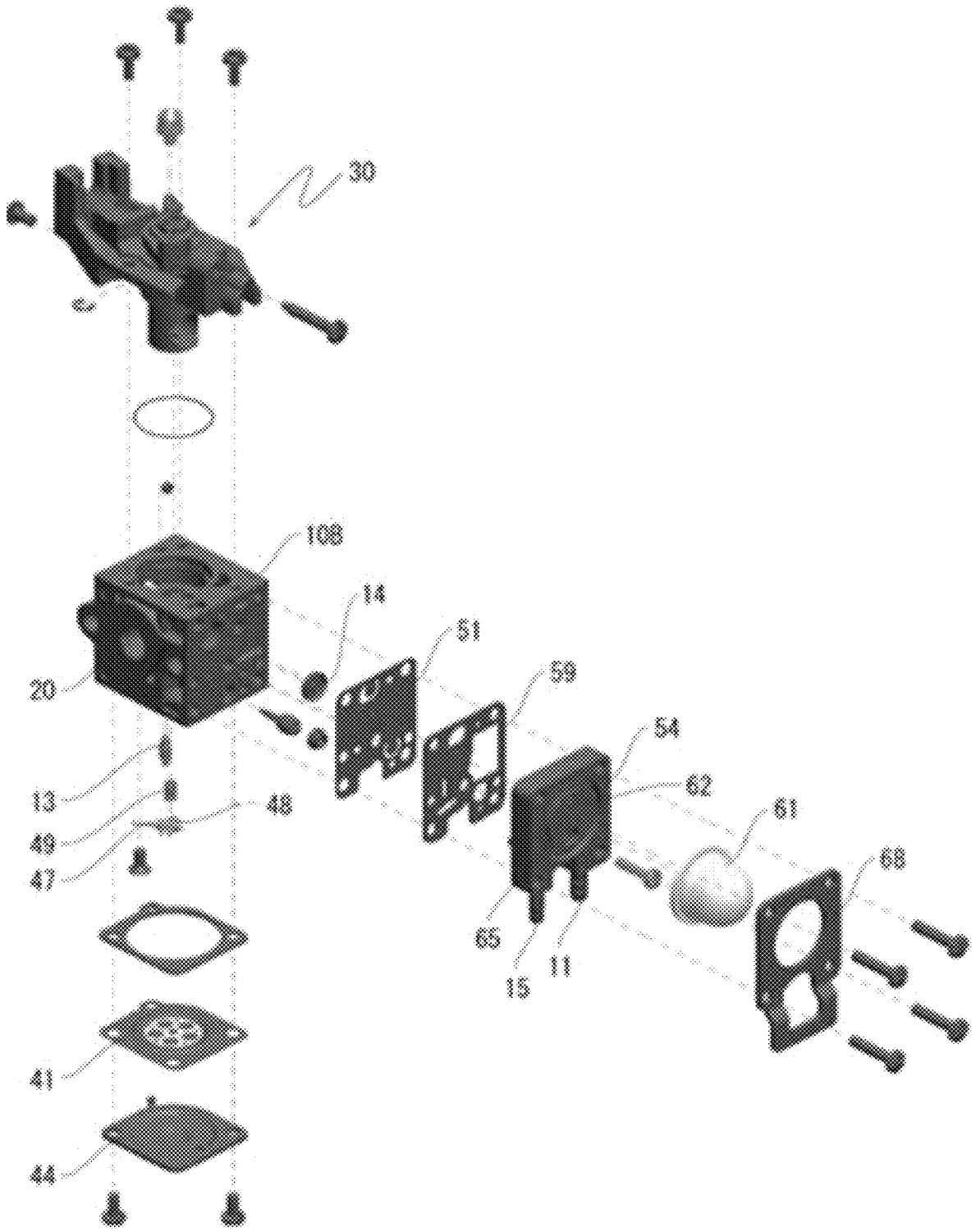
FIG. 9 (prior art)
FIG. 9 is an exploded-view illustrating various parts of a conventional carburetor provided with a manual type primary pump.
Figure 10:
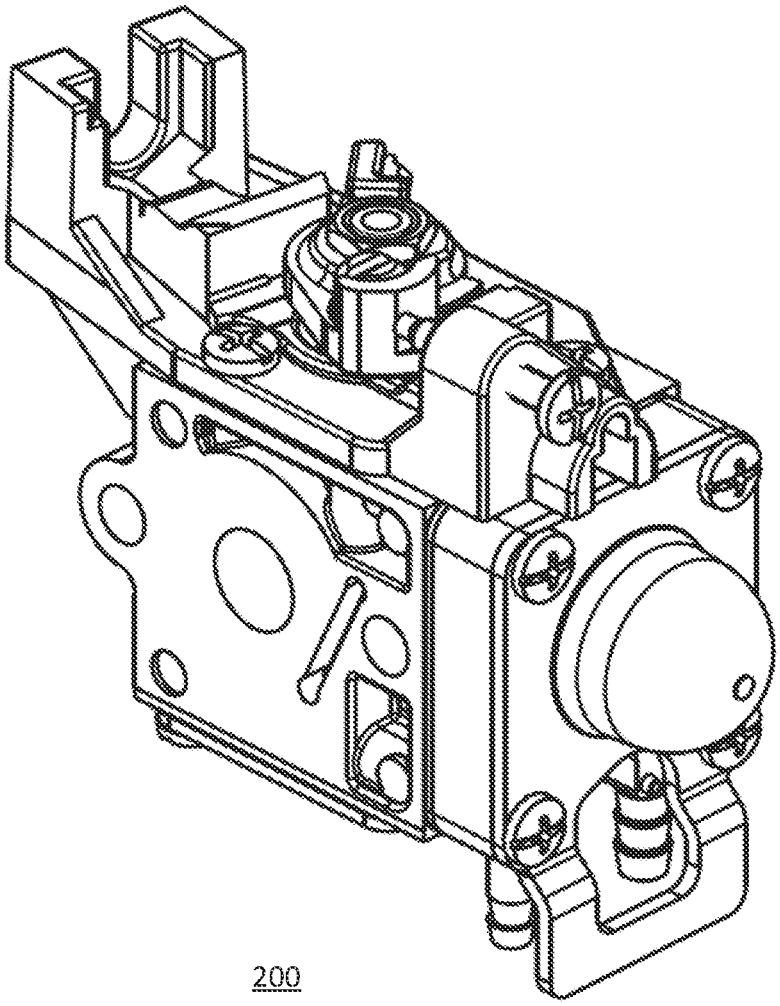
FIG. 10 (prior art)
FIG. 10 is a perspective view illustrating the assembled state of a conventional carburetor provided with a manual type primary pump.

FIG. 7, FIG. 9, and FIG. 10 are views illustrating a conventional carburetor 200. The carburetor 200 is disposed in a fuel introduction path from a fuel tank T to an engine E (see FIG. 6) to mix fuel with air and feed it to the engine. The carburetor 200 includes: an intake path 20 formed in a carburetor main body 10B; a throttle valve 30 disposed in the intake path 20 and capable of adjusting the opening surface area thereof; a metering unit 40 for feeding fuel F at a predetermined pressure to the intake path 20; a fuel pump 50; and a manual type primary pump 60 for suctioning fuel F from the fuel tank T. The interior of the metering unit 40 can be partitioned into a fixed quantity fuel chamber 42 and an air chamber 43 by a metering diaphragm 41. The interior of fuel pump 50 can be partitioned into a pulse pressure chamber 53 and a pump chamber 52 by a pump diaphragm 51, which is displaced by the pulse pressure conveyed from a crank case of the engine E to the pulse pressure chamber 53. Fuel F can be suctioned from the fuel tank T to the pump chamber 52 via a fuel introduction port 11 and sent to the fixed quantity fuel chamber 42 via a fuel sending path 12.

The carburetor 200 is a conventionally well-known rotary type carburetor with a throttle valve 30, which is a cylindrical throttle valve having a throttle through-hole 31 and a metering pin 32. As shown, the metering pin 32 is disposed in a cylindrical valve hole 21, which is orthogonally disposed with respect to the intake path 20. Further, the intake path 20 is provided with a fuel nozzle 33 disposed on the central axis of the throttle valve 30 to make an opening in the throttle through-hole 31 to insert the metering pin 32. The throttle valve 30 moves in the central axis direction thereof while rotating in response to an acceleration operation to control the air flow rate and the fuel flow rate.

A description of the detailed structure for adjusting air flow rate and fuel flow rate for this rotary type carburetor 200 will be omitted.

The metering unit 40 uses the metering diaphragm 41 to partition a space between the main carburetor body 10B and a separately installed cover body 44. The metering unit 40 is separated into the fixed quantity fuel chamber 42 (wherein the carburetor main body side 10B accumulates fuel F) and the air chamber 43 (wherein the cover body 44 side holds air at a uniform pressure via the air communication hole 45 formed in the cover body 44).

The metering diaphragm 41 includes a metal protrusion 46 in the middle thereof and a base end of a valve lever 48 that is rotatably held by a pin 47, which acts as an axis contact and engage each other due to the spring force of a spring 49. A fuel introduction valve 13 is engaged with a tip end of the valve lever 48, which opens and closes the fuel sending path 12 in response to the displacement of the metering diaphragm 41 to introduce a fixed quantity of fuel F into the fixed quantity fuel chamber 42.

The fuel F in the fixed quantity fuel chamber 42 is drawn to the throttle through-hole 31 from the fuel nozzle 33 through a fuel path 70 where the fuel is fed to the engine E. The fuel path 70 includes a check valve 71 for preventing air aspiration from the intake path 20 to the fixed quantity fuel chamber 42 and a main jet 72, which has a narrow part that sets fuel passing therethrough to a fixed quantity.

The fuel pump 50 uses a diaphragm 51 to partition the space between the carburetor main body 10B and a pump main body 54, which is mounted on another body. The fuel pump 50 is separated into the pump chamber 52, wherein the carburetor main body 10B side suctions and sends fuel F, and the pulse pressure chamber 53, wherein the pump main body 54 side introduces a pulse pressure generated by the crank case of the engine E via a pulse pressure path 19.

When the engine E operates, a positive or negative pulse pressure conveyed from the crank case is introduced to the pulse pressure chamber 53 via the pulse pressure path 19 and, as a result, the interior of the pulse pressure chamber 53 gains a negative pressure or a positive pressure to displace the pump diaphragm 51. The pump operation generated thereby suctions and sends fuel F from the fuel tank T.

Figure 11B:
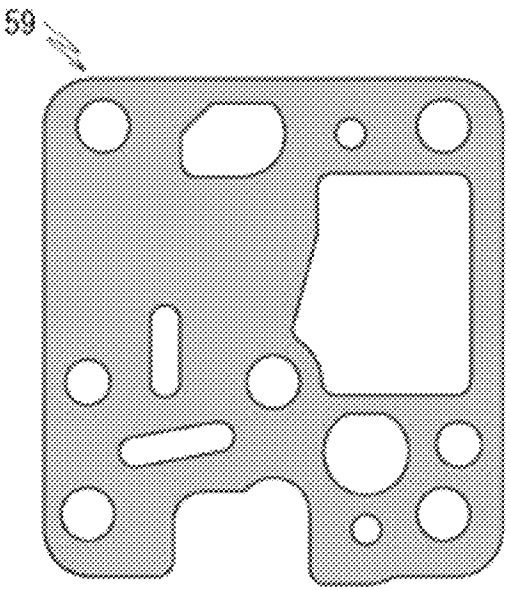
FIG. 11B is a plan view illustrating the pump diaphragm and the gasket used in the fuel pump in a conventional carburetor provided with a manual type primary pump.
Figure 11A:
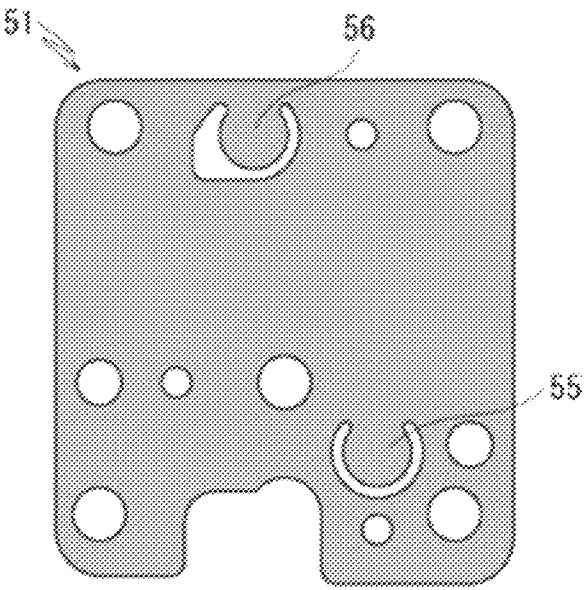
FIG. 11A is a plan view illustrating the pump diaphragm and the gasket used in the fuel pump in accordance with some embodiments of the present disclosure.

Referring to FIG. 11, the pump diaphragm 51 has two check valves formed by flaps. The first valve is an aspiration side check valve 55, which is configured to open during fuel suction when the pulse pressure is negative and to close during fuel sending when the pulse pressure is positive. The second check valve is a sending side check valve 56, which is configured to close during fuel suction when the pulse pressure is negative and to open during fuel sending when the pulse pressure is positive. Note that reference numeral 59 is a gasket that is sandwiched between the primary pump 60 and the pump diaphragm 51.

The suction side check valve 55 and the sending side check valve 56 are configured to close or open based on the respective timing of the suction and sending of the fuel F. This guides the fuel F in one direction without backflow. Note that the fuel sending path 12 has a mesh-shaped screen 14 for removing foreign material or the like.

The primary pump 60 includes a cap 61 with one end opened; an inlet side path 63 for fluidically communicating an inlet 62, which is open to an interior of the cap 61, with the fixed quantity fuel chamber 42 positioned extending from the inlet 62; an inlet side check valve 64 disposed on the inlet side path 63; an outlet side path 66 for fluidically communicating an outlet 65, which is open to the interior of the cap 61, with the fuel return port 15 positioned extending from the outlet 65; and an outlet side check valve 67 disposed on the outlet side path 66. Cap 61 is made of an elastic resin.

The cap 61 is secured tightly to the opening of the pump main body 54 via a pressing member 68. The cap 61 covers the inlet 62 and the outlet 65 formed mutually close in the pump main body 54.

The intake side check valve 64 closes when the cap 61 is pressed and compressed, and opens when the cap 61 returns to its original state after being pressed. The outlet side check valve 67 opens when the cap 61 is pressed and compressed and closes when the cap 61 returns to its original state after being pressed.

By repeatedly pressing and deforming the cap 61, a pressure to suction air in the fixed quantity fuel chamber 42 through the inlet side path 63 is generated. This feeds the fuel F suctioned from the fuel tank T (via the fuel introduction port 11) to the fixed quantity fuel chamber 42 via the pump chamber 52.

The actuation of the primary pump 60 causes fuel F to feed into the fixed quantity fuel chamber 42 and the pump chamber 52 before engine startup. Filling the interior of the fixed quantity fuel chamber 42 with fuel F for startup, and filling the interior of the pump chamber 52 with fuel F provides a priming action and enables smooth suctioning and sending of fuel F after engine startup.

After the fixed quantity fuel chamber 42 and the pump chamber 52 are filled with fuel F, any excess fuel F is returned to the fuel tank T through the outlet side path 66, which is fluidically coupled to fuel tank T via a fuel reflux port 15. This prevents fuel from overflowing in the structure.

Preferable embodiments of the present disclosure will be described below based on drawings.

Figure 1:
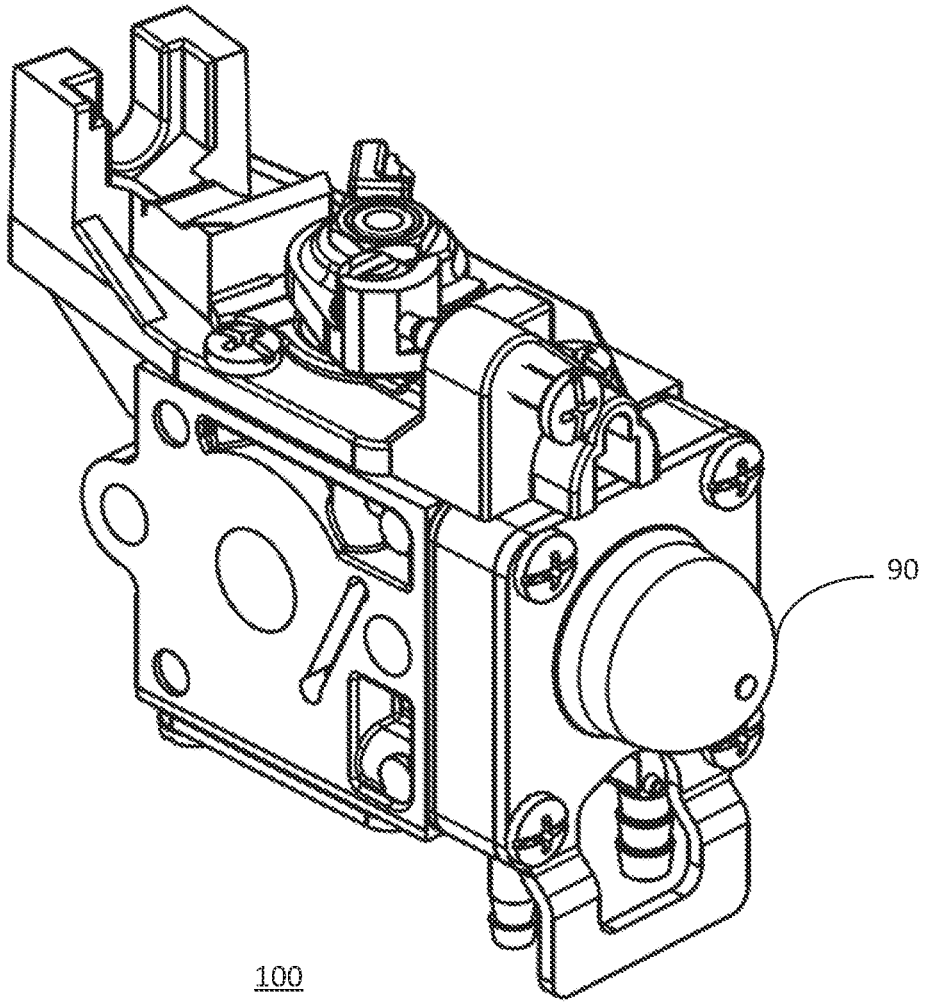
FIG. 1 is a perspective view illustrating a carburetor in accordance with some embodiments of the present disclosure.

FIG. 1 illustrates a carburetor 100 in accordance with some embodiments of the present disclosure. The carburetor 100 has substantially the same configuration as the carburetor 200 (described above), but with improvement(s) in a fuel pump 80 and a primary pump 90.

Figure 2B:
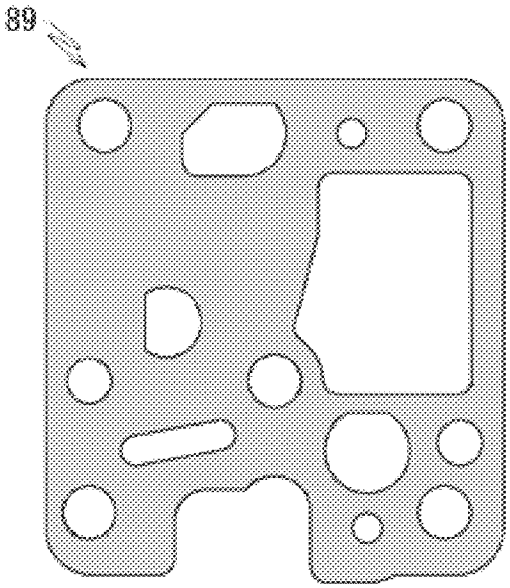
FIGS. 2A-B are plan views illustrating a pump diaphragm and a gasket used in a fuel pump of the carburetor shown in FIG. 1 in accordance with some embodiments of the present disclosure.
Figure 2A:
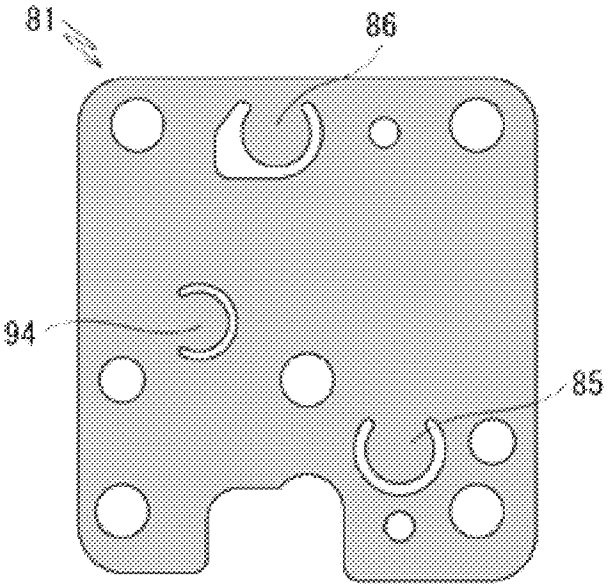

FIG. 2 is a view illustrating a pump diaphragm 81 and a gasket 89 used in the fuel pump 80 in accordance with some embodiments of the present disclosure. As illustrated in FIG. 2, the pump diaphragm 81 has two check valves 85 and 86 formed by flaps. A first flap is an aspiration-side check valve 85 that is configured to open during fuel suction when the pulse pressure is negative and to close during fuel sending when the pulse pressure is positive. A second flap is a sending-side check valve 86 that is configured to close during fuel suction when the pulse pressure is negative and to open during fuel sending when the pulse pressure is positive. Note that the gasket 89 is sandwiched between the primary pump 90 and the pump diaphragm 81. In some embodiments, the flaps 85 and 86 can have a circular shape, a polygonal shape, or the like.

The primary pump 90 can be the same as the primary pump in the carburetor 200 in that it also includes a cap 91, which has an open end and is made of an elastic resin. The primary pump 90 also includes: an inlet open to the interior of the cap 91 and an inlet side path 93 extending from the inlet; an inlet side check valve 94 disposed in the inlet side path 93; an outlet open to the interior of the cap 91 and an outlet side path extending from the outlet; and an outlet side check valve disposed in the outlet side path.

Figure 3B:
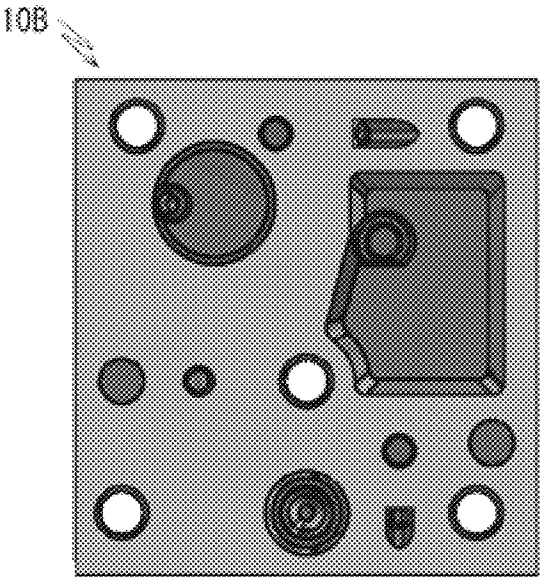
FIG. 3B illustrates a surface contacting the pump main body in the main body of a conventional carburetor as a comparative example.
Figure 3A:
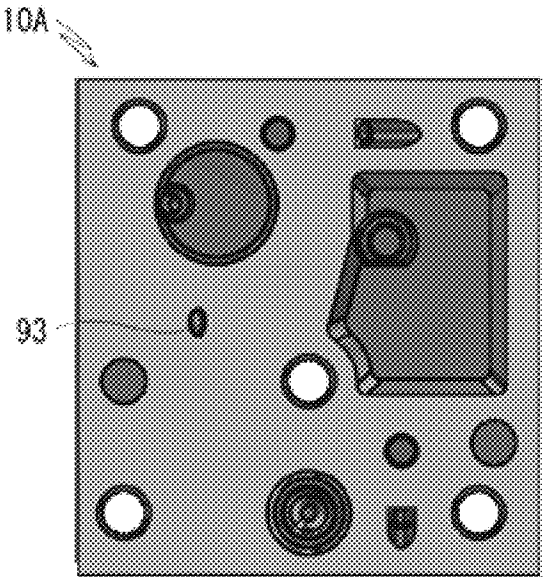
FIG. 3A illustrates a surface contacting the pump main body in the main body of the carburetor shown in FIG. 1 in accordance with some embodiments of the present disclosure.
Figure 4:
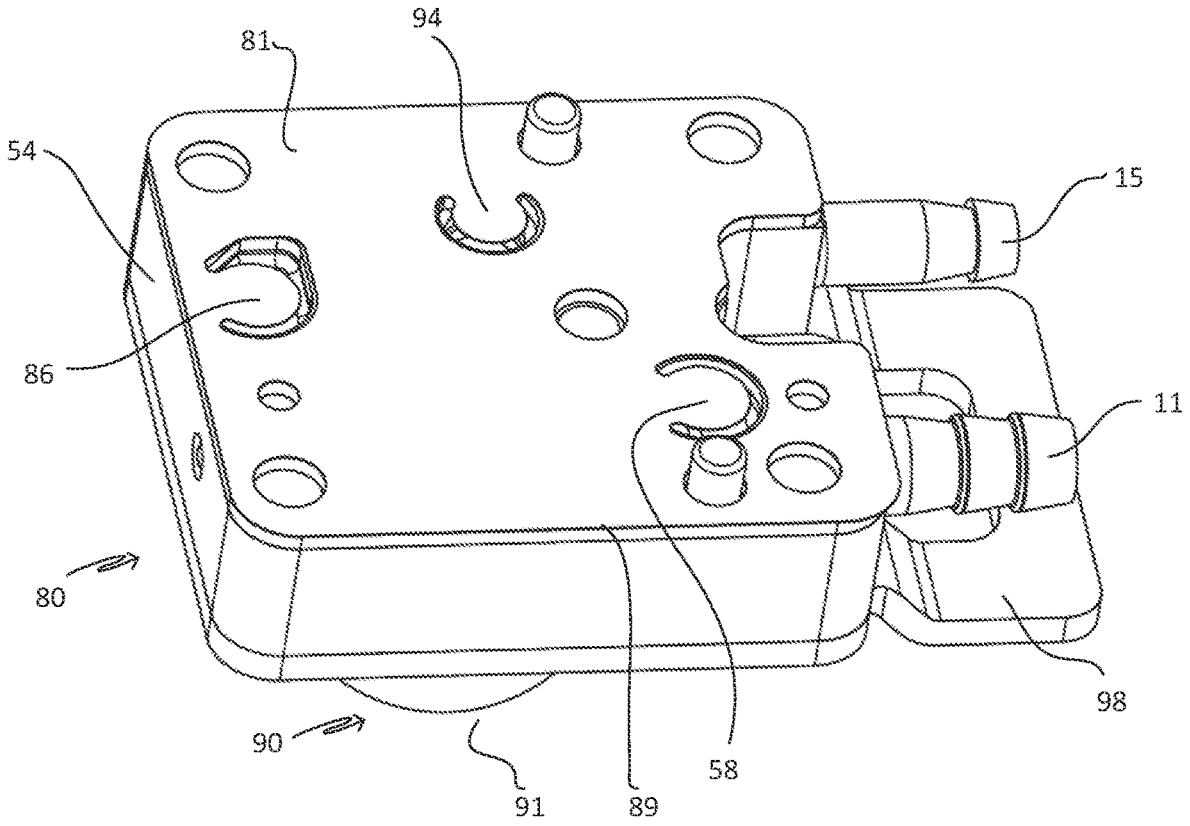
FIG. 4 is a perspective view illustrating the primary pump and the fuel pump of the carburetor in accordance with some embodiments of the present disclosure.

FIGS. 3 and 4 illustrate the primary pump 90 in accordance with some embodiments of the present disclosure. As shown in FIG. 4, the inlet side check valve 94 can be a flap formed in the pump diaphragm 81. FIG. 3(*a*) illustrates a surface interface of diaphragm 81. The surface interface of diaphragm 81 is configured to be in contact with the pump main body 54 of the carburetor main body 10A (see FIG. 5A) of the carburetor 100. As a comparative example, FIG. 3(*b*) illustrates the surface interface configured to be in contact with the pump main body 54 of main body 10B of the carburetor 200 (described above in regards to FIG. 7).

FIG. 4 is a perspective view shown from the surface side where the fuel pump 80 contacts the main body 10A of the carburetor 100 and illustrates the fuel pump 80 and the primary pump 90 in accordance with some embodiments of the present disclosure. Note that reference numeral 98 is a pressing member that suppresses the cap 91.

Figure 5B:
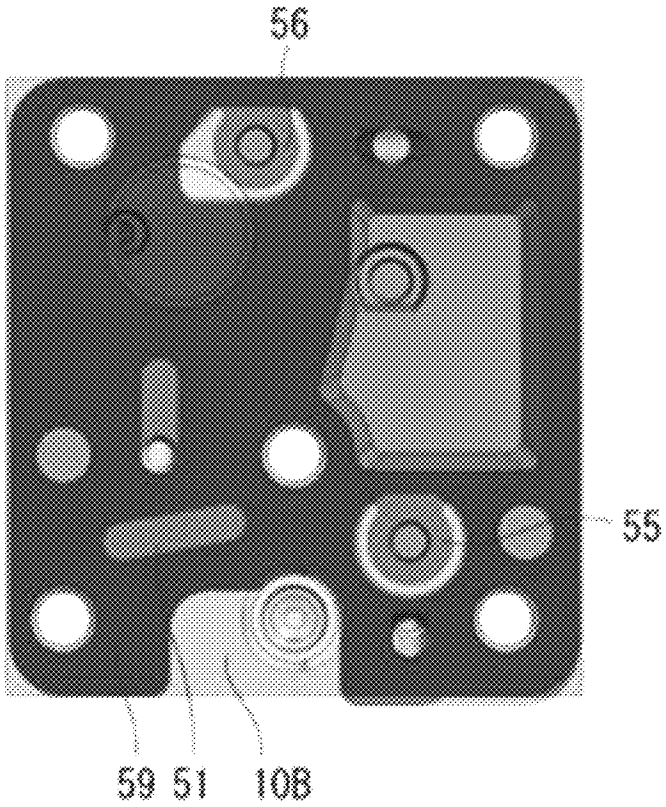
FIG. 5B illustrates the assembled state of the sequentially superimposed carburetor main body, pump diaphragm, and gasket of a conventional carburetor as a comparative example.
Figure 5A:
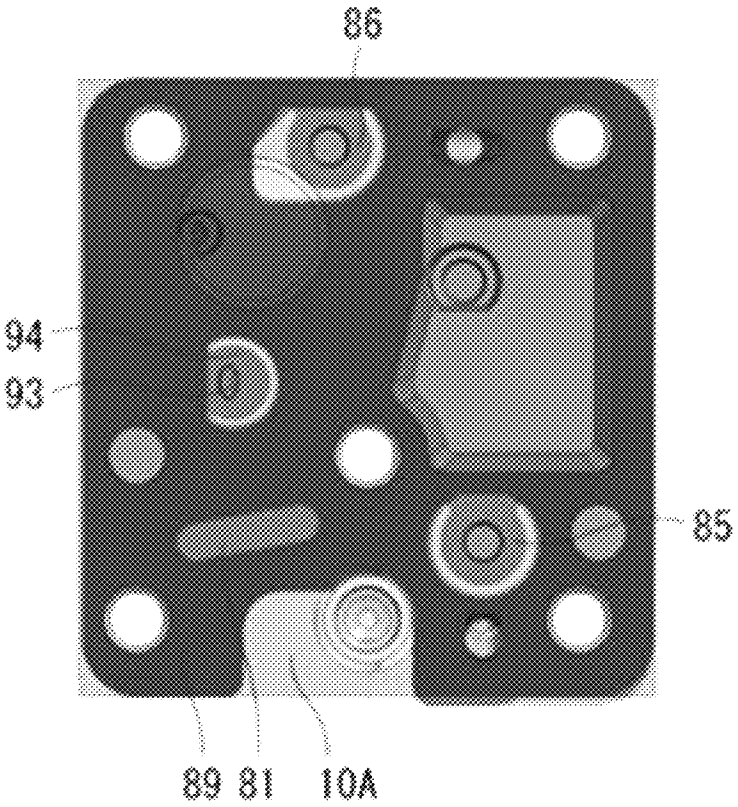
FIG. 5A illustrates the assembled state of the sequentially superimposed carburetor main body, pump diaphragm, and gasket of the carburetor in accordance with some embodiments of the present disclosure.

FIG. 5(*a*) is a view illustrating the assembled state of the sequentially superimposed carburetor main body 10A, pump diaphragm 81, and gasket 89 of the carburetor 100 in accordance with some embodiments of the present disclosure. As a comparative example, FIG. 5(*b*) is a view illustrating the assembled state of the sequentially superimposed carburetor main body 10B, pump diaphragm 51, and gasket 59 of carburetor 200 (described above in regards to FIG. 7).

Referring to FIGS. 4 and 5(*a*), when actuated, the cap 91 of the primary pump 90 suctions the fuel F from the fuel tank T as the inlet side check valve 94 opens due to the suction force generated by the actuation of the cap 91. The air in the fixed quantity fuel chamber 42 is suctioned through the inlet side path 93, and the fuel is suctioned from the fuel tank T via the fuel introduction port 11. The fuel is then fed to the fixed quantity fuel chamber 42 through the pump chamber 52.

In some embodiments, the inlet side check valve 94 can be constructed by a flap formed in the pump diaphragm 81. Similarly, the outlet side check valve can also be constructed by another flap formed in the pump diaphragm 81 (not illustrated). In other words, both of the inlet side and outlet side check valves may both be configured by flaps formed in the pump diaphragm 81.

A flap can serve as at least one check valve from among the check valves on the inlet side and the outlet side of the primary pump 90 that suctions fuel to be used during engine startup. The flaps formed on the pump diaphragm 81, which function as check valves of the fuel pump 80 for feeding and sending fuel using a pulse pressure of the engine E, can also provide excellent primary pump function. By using flap check valves formed on the pump diaphragm 81 for primary pump function, the number of components can be reduced, and cost reduction can be achieved. Further, the check valve function exhibited by a flap enables simple construction and space reduction (form factor) as compared to conventional check valves using a spring, a ball, or the like.

LIST OF REFERENCE NUMBERS

10 carburetor main body
11 fuel introduction port
12 fuel sending path
13 fuel introduction valve
14 screen
15 fuel return port
20 intake path
30 throttle valve
31 throttle through hole
32 metering pin
33 fuel nozzle
40 metering unit
41 metering diaphragm
42 fixed quantity fuel chamber
43 air chamber
44 cover body
45 air communication hole
46 protrusion
47 pin
48 valve lever
49 spring
50 fuel pump
51 pump diaphragm
52 pump chamber
53 pulse pressure chamber
54 pump main body
55 aspiration side check valve
56 sending side check valve
59 gasket
60 primary pump
61 cap, 62 inlet
63 inlet side path
64 inlet side check valve
65 outlet
66 outlet side path
67 outlet side check valve
68 pressing member
70 fuel path
71 check valve
72 main jet
80 fuel pump
81 pump diaphragm
85 aspiration side check valve
86 sending side check valve
89 gasket
90 primary pump
91 cap
93 inlet side path
94 inlet side check valve
98 pressing member
100 carburetor
200 carburetor
T fuel tank
F fuel
P1 pump chamber
P2 pulse pressure chamber
PD pump diaphragm Various aspects of the present subject matter are set forth below, in review of, and/or in supplementation to, the embodiments described thus far, with the emphasis here being on the interrelation and interchangeability of the following embodiments. In other words, an emphasis is on the fact that each feature of the embodiments can be combined with each and every other feature unless explicitly stated otherwise or logically implausible.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

As used herein and in the appended claims, the singular forms "a," "an," and "the" include plural referents unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

The invention claimed is:

1. A manual type primary pump for a carburetor for mixing fuel and air, the carburetor having a fuel pump with a pump diaphragm, the primary pump comprising:

a flexible cap having an interior cavity;

an inlet in fluid communication with the interior cavity of the flexible cap;

an inlet side path formed extending from the inlet;

an inlet side check valve disposed on the inlet side path;

an outlet in fluid communication with the interior cavity of the flexible cap;

an outlet side path is coupled the outlet; and an outlet side check valve disposed on the outlet side path, wherein at least one among the inlet side check valve and the outlet side check valve comprises a flap formed on a pump diaphragm for a fuel pump for the carburetor.

2. The manual type primary pump of claim 1, wherein the flexible cap is formed from a resin.

3. The manual type primary pump of claim 1, wherein the flap comprises a flexible flap.

4. A carburetor for mixing fuel and air and feeding it to an engine, being disposed in a fuel introduction path from a fuel tank to the engine, the carburetor comprising:

an intake path formed in the carburetor main body;

a throttle valve disposed in the intake path, the throttle is configured to adjust the opening surface area thereof;

a metering unit for feeding fuel at a predetermined pressure to the intake path, an interior of the metering unit being partitioned by a metering diaphragm into a fixed quantity fuel chamber and an air chamber;

a fuel pump having an interior being partitioned by a pump diaphragm into a pulse pressure chamber and a pump chamber, the pump diaphragm is configured to be displaced by a pulse pressure conveyed to the pulse pressure chamber from a crank case of the engine; and a primary pump for suctioning fuel from the fuel tank, the primary pump further comprises:

a flexible cap having a cavity;

an inlet open to the cavity of the flexible cap;

an inlet side path connecting the fixed quantity fuel chamber to the inlet;

an inlet side check valve disposed in the inlet side path;

an outlet open to the cavity of the flexible cap;

an outlet side path connecting the fuel tank to the outlet; and an outlet side check valve disposed in the outlet side path, wherein at least one among the inlet side check valve and the outlet side check valve comprises a flap formed in the pump diaphragm.

* * * * *